US007270039B2

(12) United States Patent
Lindee et al.

(10) Patent No.: US 7,270,039 B2
(45) Date of Patent: Sep. 18, 2007

(54) RELOAD SYSTEM FOR SLICING MACHINE

(75) Inventors: Scott A. Lindee, Mokena, IL (US); Steven C. Ill, Mokena, IL (US); James E. Pasek, Mokena, IL (US)

(73) Assignee: Formax, Inc., Mokena, IL (US)

( * ) Notice: Subject to any disclaimer, the term of this patent is extended or adjusted under 35 U.S.C. 154(b) by 164 days.

(21) Appl. No.: 10/247,126

(22) Filed: Sep. 19, 2002

(65) Prior Publication Data

US 2004/0055439 A1 Mar. 25, 2004

(51) Int. Cl.
*B26D 7/06* (2006.01)
*B26D 1/157* (2006.01)

(52) U.S. Cl. ..... 83/277; 83/280; 83/409; 83/417; 83/932

(58) Field of Classification Search ..... 83/279, 83/280, 417, 932, 228, 250, 251, 272, 276–278, 83/281, 42, 252–254, 409, 409.1, 409.2
See application file for complete search history.

(56) References Cited

U.S. PATENT DOCUMENTS 4,428,263 A 1/1984 Lindee et al.
4,457,194 A * 7/1984 Mally ..... 83/42
4,522,093 A 6/1985 Rattmann
4,583,435 A * 4/1986 Fessler ..... 83/90
4,644,729 A 2/1987 Fessler
5,566,600 A * 10/1996 Johnson et al. ..... 83/77
5,628,237 A 5/1997 Lindee et al.
5,649,463 A 7/1997 Lindee et al.
5,697,275 A * 12/1997 Lindee et al. ..... 83/932 X
5,704,265 A 1/1998 Johnson et al.
5,724,874 A * 3/1998 Lindee et al. ..... 83/932 X
5,974,925 A 11/1999 Lindee et al.

FOREIGN PATENT DOCUMENTS

EP 0 713 753 A2 5/1996

* cited by examiner

*Primary Examiner*—Clark F. Dexter
(74) *Attorney, Agent, or Firm*—The Law Office of Randall T. Erickson, P.C.

(57) ABSTRACT

A loaf reload mechanism for a slicing machine that includes a loaf-loading position wherein during a loading operation a loaf is placed in the loaf-loading position to be engaged by a gripper and driven into a cutting plane. The loaf reload mechanism includes a loaf-staging position located over the loaf-loading position, the loaf-staging position having a lowering mechanism to position a loaf from the loaf-staging position to the loaf-loading position. The reload mechanism also includes a loaf-ready position located laterally adjacent to the loaf-staging position, and a sweep mechanism configured to laterally move a loaf from the loaf-ready position into the loaf-staging position.

14 Claims, 8 Drawing Sheets

RELOAD SYSTEM FOR SLICING MACHINE

TECHNICAL FIELD OF THE INVENTION

The invention relates to food-loaf slicing machines. Particularly, the invention relates to loaf reload systems for food loaf-slicing machines.

BACKGROUND OF THE INVENTION

Many different kinds of food loaves are produced; they come in a wide variety of shapes and sizes. There are meat loaves made from various different meats, including ham, pork, beef, lamb, turkey, and fish. These meat loaves come in different shapes (round, square, rectangular, oval, etc.) and in different lengths. The cross-sectional sizes of the loaves are also variable. Loaves of cheese or other foods also vary in shape, length, and transverse size.

Typically, the food loaves are sliced, the slices are grouped in accordance with a particular weight requirement, and groups of slices are packaged and sold at retail. For some products, neatly aligned stacked slice groups are preferred. For others, the groups are shingled so that a purchaser can see a part of every slice through a transparent package.

U.S. Pat. No. 4,428,263 describes a high speed food loaf-slicing machine. Some other known high speed food slicing machines have provided for slicing two food loaves simultaneously with a single, cyclically driven knife blade, such as described in U.S. Pat. Nos. 5,628,237; 5,649,463; 5,704,265; 5,974,925; and European published application EP 0 713 753 A2.

U.S. Pat. No. 5,628,237 and European published application EP 0 713 753 A2 describe a back-clamp type slicing machine. According to this type of slicing machine, two loaves are loaded onto a lift tray and the lift tray is raised to a ready-to-sweep position. Two loaf grippers are retracted after the previous loaves are sliced. During retraction of the loaf grippers, loaf-to-slicing blade gate doors are closed and butt ends of the previous loaves are dropped through a butt door. After the grippers have reached the retracted position or "home position" remote from the slicing blade, a loaf sweep mechanism is activated, moving the loaves about 20.6 inches laterally into the slicing position. The grippers then advance after it has been determined that the loaf sweep mechanism has moved the loaves to the slicing position. After sensing and gripping the loaves, the loaves are retracted slightly, and the loaf-to-slicing blade gate doors are opened and the loaves are advanced to the slicing plane of the slicing blade. The loaf sweep mechanism retracts and the loaf lift tray lowers, ready for the next reload cycle. According to this design, in practice, the reload cycle is accomplished in about six seconds. In a high volume slicing operation, reload cycle time can be a significant limitation to optimum production efficiency.

The present inventors have recognized that it would be advantageous to provide a more time-effective method of reloading slicing machines.

SUMMARY OF THE INVENTION

The present invention provides a new and improved automatic loaf loading arrangement for a slicing machine that effectively reduces the loaf reload cycle time between successive reloads.

According to one aspect, the invention provides a high speed food loaf slicing machine, including: food loaf support means defining a food loaf path, loaf feed means that grips and feeds a food loaf along the food loaf path toward a slicing station, and then retracts, and a food loaf reload mechanism for progressively reloading a succeeding loaf from a staging position into the food loaf path during retraction of the loaf feed means. According to a preferred embodiment, the staging position is over the food loaf path, although the invention encompasses a staging position oriented at any position adjacent to the food loaf path.

According to another aspect of the invention, the reload mechanism can comprise a loaf storage tray for storing a food loaf in a ready position, ready for transfer to a staging position over the loaf path, first loaf transfer means for moving a food loaf from the loaf storage tray to the staging position, and second loaf transfer means for moving the food loaf from the staging position to the loaf path.

According to one embodiment of the invention, a loaf-loading mechanism is provided for a slicing machine that includes a loaf-loading position. During a loading operation, a loaf is placed in the loaf-loading position, and a gripper moves from a home position that is clear of a loaf in the loaf-loading position, to an engagement position wherein the gripper engages a trailing end of the loaf. During a slicing operation, the gripper moves with the loaf along a longitudinal path, the loaf moving into a slicing plane of a moving slicing blade, until the loaf is effectively entirely sliced by the blade. The gripper is then retracted in a reverse direction to the home position. During the retraction, the gripper is released over an open space to discharge a buff end of the loaf.

The loading mechanism of the invention provides a loaf-staging position over the loaf-loading position, the loaf-staging position having a loaf-lowering mechanism to position a loaf from the loaf-staging position to the loaf-loading position. A loaf-ready position is located laterally adjacent to the loaf-staging position. During a reload cycle, a sweep mechanism is configured to laterally move a new loaf from the loaf-ready position into the loaf-staging position.

The loaf-lowering mechanism comprises a series of loaf supports spaced apart along the longitudinal direction of the loaf path that are sequentially removed along the longitudinal direction as the gripper is retracted, to sequentially undermine the loaf to cause the loaf to drop progressively into the loaf-loading position as the gripper is retracted.

The invention minimizes the time it takes to reload a loaf into a high-speed slicing machine by staging the next loaf to be sliced over the loaf currently being sliced. That way, as the gripper is retracting, the next loaf may be lowered into the slicing position while the grippers are retracting. The support rods may be retracted sequentially, such that the product will progressively fall into the slicing position so that the grippers may be immediately advanced to grip the new loaf. The time savings is the time it heretofore took to wait for the grippers to fully retract, and then to sweep the product into position in front of the grippers.

The reload mechanism has the potential to greatly increase productivity. As in the case of bacon slicing, where the bacon slabs or bellies are small, the reload time takes a significant proportion of the cycle time for each belly. For example, if it takes nine seconds to slice an eight pound belly and the typical reload time is 6 seconds, the total time for converting that belly is 15 seconds or four bellies in a minute. According to the invention, if the reload time can be reduced to three seconds, then the total for a belly is twelve seconds or five bellies in a minute. This represents an increase in productivity of 25 percent.

Another embodiment slicing machine of the invention comprises a slicing station including a knife blade and a knife blade drive that drives the knife blade along a predetermined cutting path. A loaf support means supports a first food loaf and a second food loaf for movement along parallel first and second loaf paths, respectively, into the slicing station for repetitive slicing of both loaves by the knife blade. The invention provides an improved loaf reload system wherein after the two loaves are sliced, two new loaves are dropped from staging positions over the first and second loaf paths into the first and second loaf paths. The two loaves can be independently deposited into the first and second loaf paths. Two new loaves can then be swept laterally from ready positions into the staging positions.

Numerous other advantages and features of the present invention will be become readily apparent from the following detailed description of the invention and the embodiments thereof, from the claims and from the accompanying drawings.

DETAILED OF THE PREFERRED EMBODIMENTS

Figure 1:
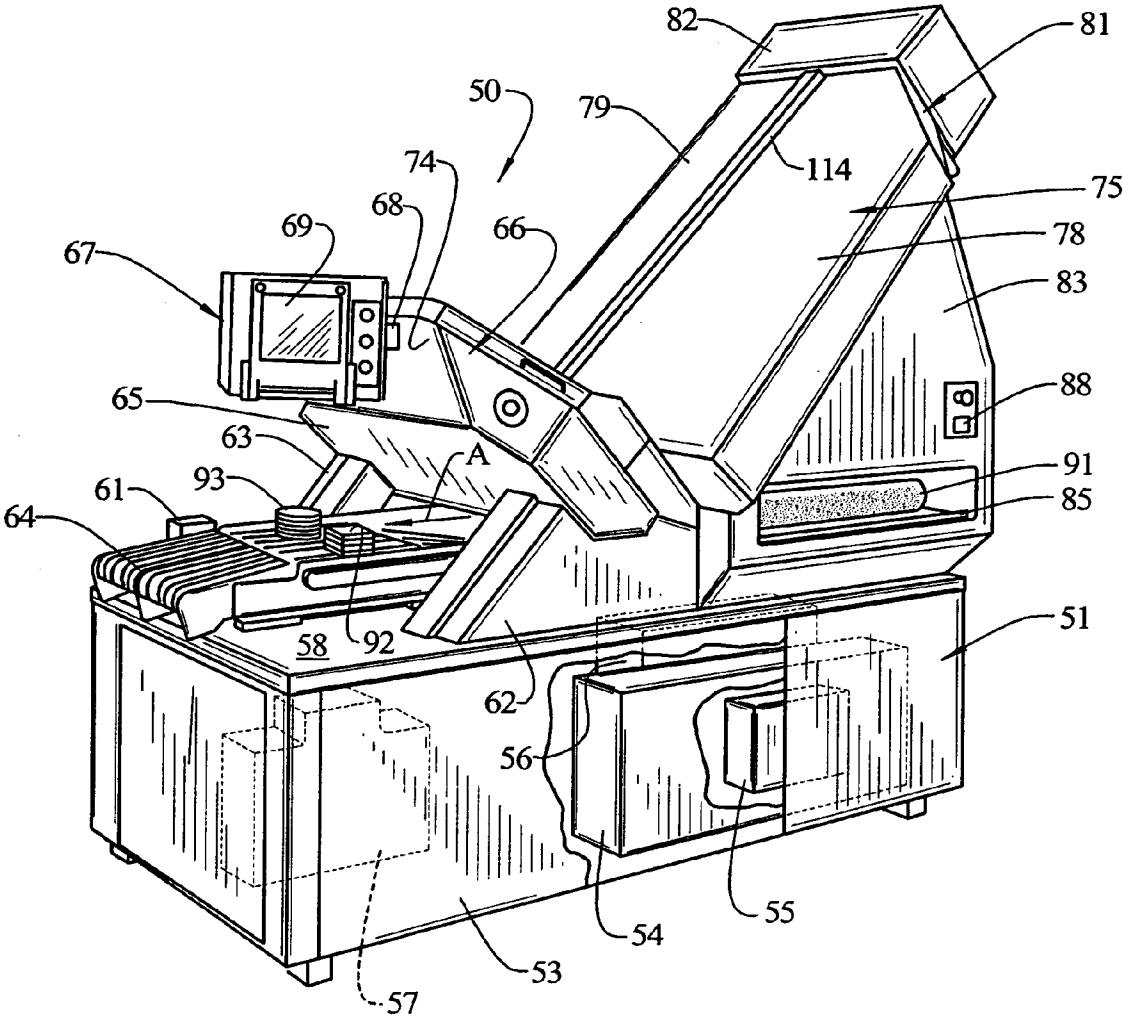
FIG. 1 is a perspective view of a slicing machine comprising a preferred embodiment of the invention, the portions of the covers on the machine base cut away to show typical power supply and computer enclosures.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a food loaf slicing machine 50 constructed in accordance with a preferred embodiment of the present invention. The slicing machine 50 is of a type described in U.S. Pat. Nos. 5,628,237; 5,649,463; 5,704,265; 5,974,925; and European published application EP 0 713 753 A2, herein incorporated by reference. Slicing machine 50 comprises a base 51. Base 51 has a housing or enclosure 53 surmounted by a top 58. Base 51 typically affords an enclosure for a controller or computer 54, a low voltage supply 55, a high voltage supply 56, and a scale mechanism 57. Base enclosure 53 may also include a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45° and terminate at the bottom 65 of a slicing station 66; member 65 constitutes a part of the housing for slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing head 66. Cabinet 67 and its computer display touch screen 69 are pivotally mounted so that screen 69 can face either side of slicing machine 50, allowing machine 50 to be operated from either side.

The upper right-hand portion of slicing machine 50, as seen in FIG. 1, comprises a loaf feed mechanism 75 which, in machine 50, includes a manual feed from the right-hand (far) side of the machine and the automated feed from the left-hand (near) side of the machine. Loaf feed mechanism 75 has an enclosure that includes a far side manual loaf loading door 79 and a near side automatic loaf loading door 78. Slicing machine 50 is equipped for automated loading of loaves from the near side, as seen in FIG. 1, and manual loading on the far side of the machine. It will be understood that automated loaf loading may be provided on either or both sides of the machine.

Slicing machine 50, FIG. 1, further includes a pivotal upper back frame 81 and an upper back housing 82. Back frame 81 supports the upper ends of many of the components of loaf feed mechanism 75. A loaf feed guard 83 protects the near side of the loaf feed mechanism 75 and shields mechanism 75 from a machine operator. There may be a similar guard on the opposite side of the machine. Behind loaf feed guard 83 there is a loaf lift tray 85 to load a food loaf into mechanism 75 during an automated loaf loading operation in machine 50 as described in detail below. A fixed loaf storage tray, used for manual loaf loading, may be located on the opposite side of machine 50 but is not visible in FIG. 1.

A loaf lift switch 88 is provided for initiating automated loading of a loaf from tray 85 into mechanism 75. There would be a like switch on the opposite side of slicing machine 50 if that side of the machine were equipped for automated loaf loading. Switch 88 and any counterparts on the opposite (far) side of slicing machine 50, are all electrically connected to the controls in enclosure 53.

As shown in FIG. 1, slicing machine 50 is ready for operation. There is a food loaf 91 on tray 85, waiting to be loaded into loaf feed mechanism 75 on the near side of machine 50. Two, three, or even four food loaves may be stored on tray 85, depending on the loaf size. A similar food loaf or loaves may be stored on a corresponding loaf lift tray on the opposite side of machine 50. Machine 50 produces a series of stacks 92 of food loaf slices that are fed outwardly of the machine in the direction of the arrow A, by conveyor/classifier system 64. Machine 50 also produces a series of stacks 93 of food loaf slices that also move outwardly of the machine on its output conveyor system 64 in the direction of arrow A. Stack 92 is shown as comprising slices from a rectangular loaf, and stack 93 is made up of slices from a round loaf. Usually, both of the slice stacks 92 and 93 would be either round or rectangular. Stacks 92 and 93 may have different heights, or slice counts, and hence different weights; as shown, they contain the same number of food loaf slices in each stack, but that condition can be changed. Both groups of slices can be overlapping, "shingled" groups of slices instead of having the illustrated stacked configuration. Groups 92 and 93 must be the same in one respect; both must be stacks or shingle groups. Three or more loaves can be sliced simultaneously; slicing of two loaves is more common.

Figure 2:
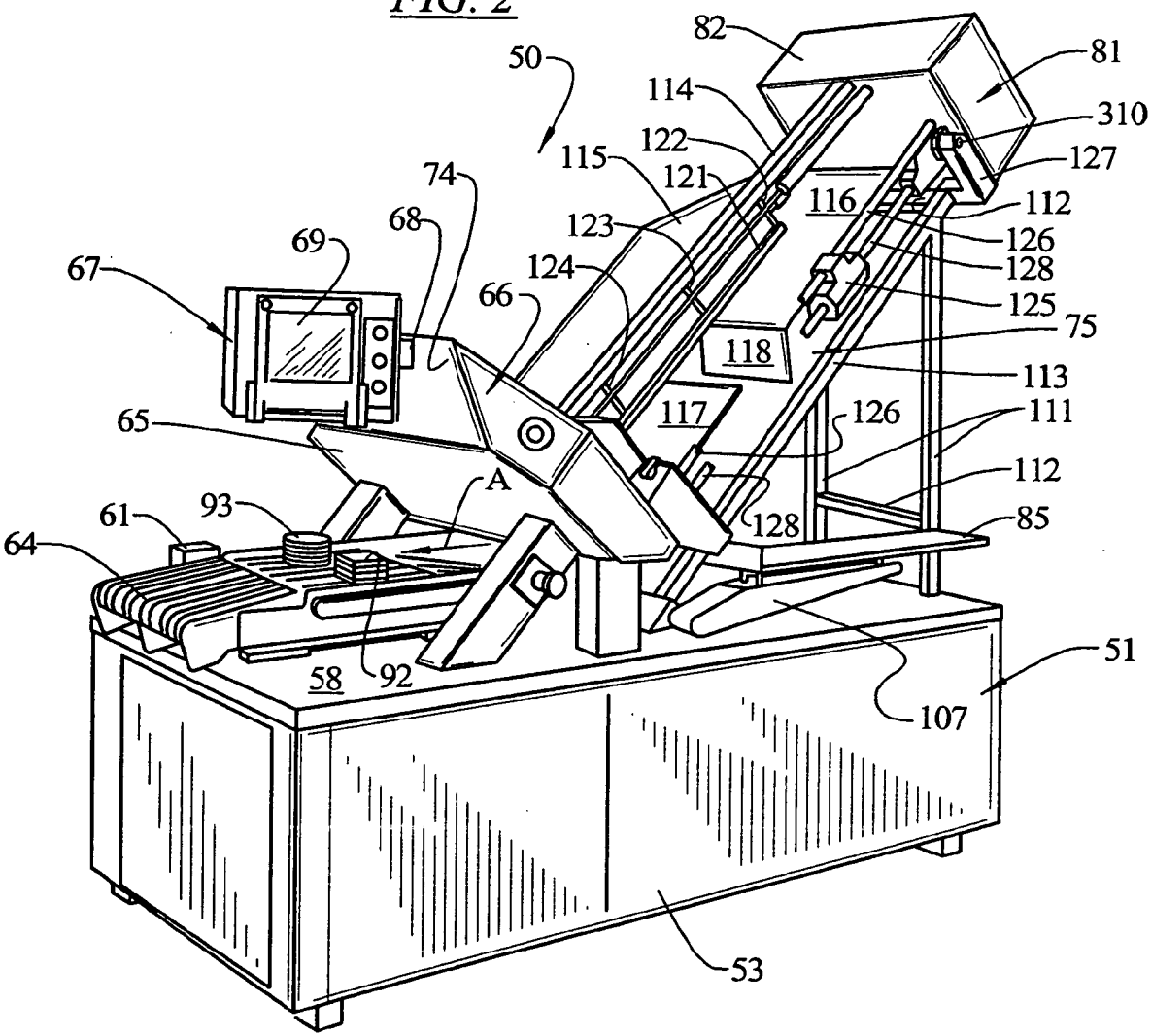
FIG. 2 is a perspective view, like FIG. 1, with some guards and covers for the loaf feed mechanism removed and some operating components shown in simplified form.

FIG. 2 illustrates the slicing machine 50 of FIG. 1 with a number of the covers omitted to reveal operating components of the automated loaf feed mechanism 75 on the near side of the machine. A loaf tray pivot mechanism 107 is located above top 58 of base 51 on the near side of slicing machine 50. Mechanism 107 is connected to and operates the automatic loaf lift tray 85, as described below. A similar loaf tray pivot mechanism may be provided on the opposite side of slicing machine 50 in a machine equipped for automated loaf loading from both sides.

Slicing machine 50 includes a fixed frame pivotally supporting the automated feed mechanism 75 for feeding food loaves into slicing head 66. In the construction shown in FIG. 2, this fixed frame includes a pair of vertical frame members 111 affixed to base 51 and interconnected by two horizontal frame members 112 and joined to two angle frame members 113 (only one shows in FIG. 2). Frame members 111-113 are all located above the top 58 of machine base 51. The frame for loaf feed mechanism 75 in slicing machine 50 also includes a frame member 114 that extends from the upper back frame 81 downwardly, parallel to frame members 113, toward slicing head 66. The upper back frame 81 is mounted on pivot pins 310 between the upper ends of two fixed frame members 127; only one member 127 appears in FIG. 2. All of the operating elements of the automated food loaf feed mechanism are mounted on the back frame and are pivotally movable (through a small angle) relative to the fixed frame 111-113.

A manual feed tray 115 is shown at the far side of slicing machine 50 as illustrated in FIG. 2.

At the top of slicing machine 50, as seen in FIG. 2, there is an upper loaf support tray 116 that has its upper surface aligned with the top surface of a lower loaf support tray 117. Supports 116 and 117 are preferably one piece, being joined by side members omitted in FIG. 2 to avoid overcrowding. The gap between loaf supports 116 and 117 is normally filled by a loaf end discharge door 118; thus, members 116-118 normally afford a continuous loaf support surface that is the bottom for the two loaf paths in slicing machine 50. In FIG. 2, however, door 118 is shown in its open discharge position. Door 118 is hinged at the lower edge of loaf support 116 and can be elevated to provide a direct, uninterrupted surface for support of a loaf throughout mechanism 75 during most of the slicing operations carried out by machine 50.

The loaf feed mechanism 75 of slicing machine 50, FIG. 2, further includes a central barrier or divider 121. This central barrier/divider 121 is suspended from frame member 114 by a plurality of pivotal supports 122, 123 and 124. During operation of slicing machine 50, divider 121 is elevated from the position shown in FIG. 2, as shown in FIG. 6, particularly the position marked 121A, to permit loading of one or more food loaves onto the support rod 622 of each of the support mechanisms 602, 604, 606, 612, 614, 616, described below and shown in one or more of FIGS. 5, 6 and 7 and FIG. 8, schematically. Barrier 121 is also elevated during loaf slicing so that it will not interfere with other components of mechanism 75.

The part of food loaf feed mechanism 75 shown in FIG. 2 also includes a carriage 125 that is mounted upon a rotatable shaft 126 and a stationary shaft 128 that extend parallel to the loaf support 116-118 throughout the length of food loaf feed mechanism 75. That is, carriage 125 moves along shafts 126 and 128 on a path approximately parallel to support members 113. There is a like carriage, carriage shafts, and carriage drive on the far side of slicing machine 50.

Figure 3:
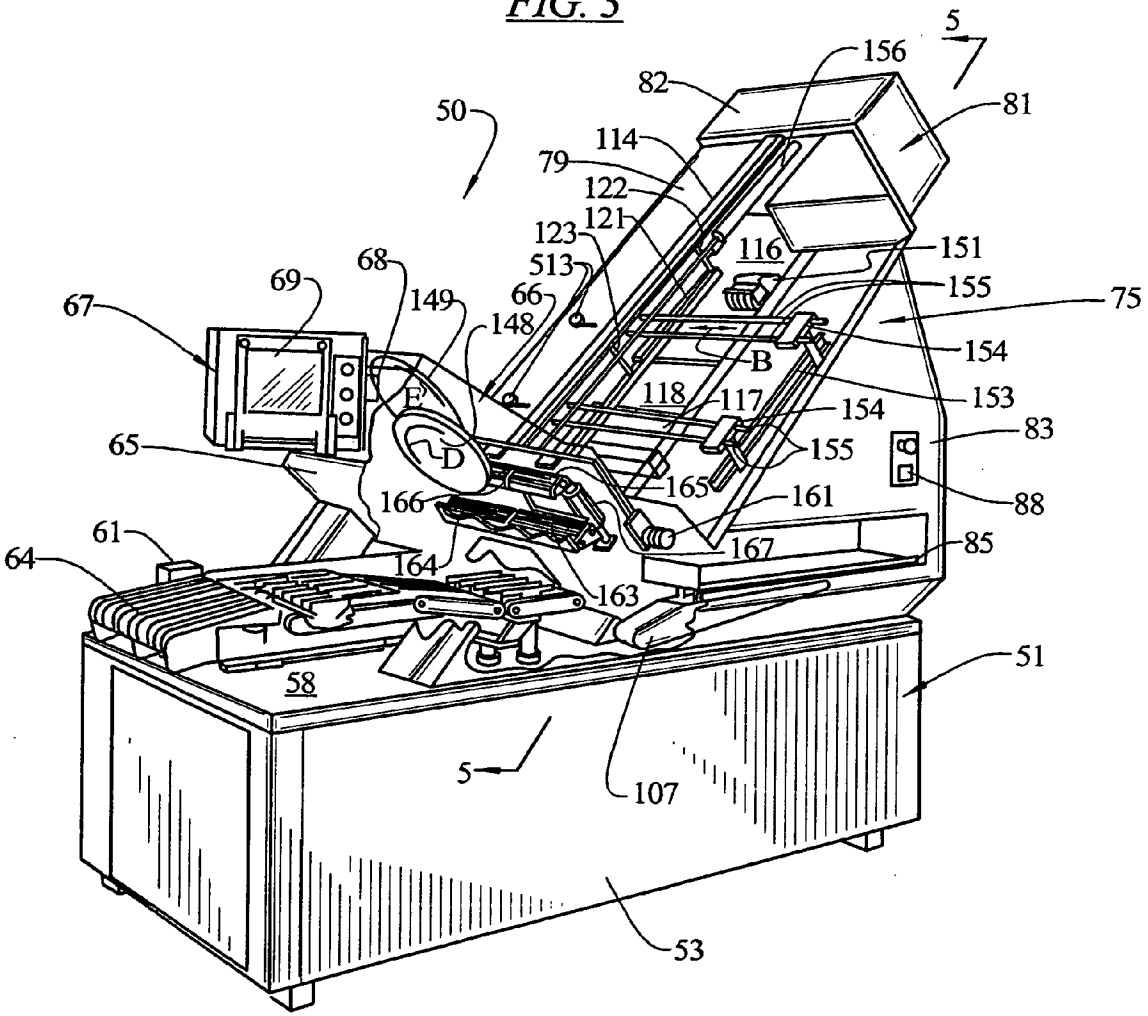
FIG. 3 is a perspective view, like FIGS. 1 and 2, with some guards and covers cut away to show further operating components of the slicing machine, some illustrated in simplified form.

As shown in the FIG. 3, loaf feed mechanism 75 includes a near side clamp or gripper mechanism 151. There is a similar gripper mechanism (not shown) at the far side of slicing machine 50. Gripper 151, which is connected to carriage 125 (FIG. 2), may have any of the constructions shown and described in U.S. Pat. No. 5,628,237 and European published application EP 0 713 753 A2, herein incorporated by reference.

Loaf feed mechanism 75 further comprises a near side sweep member 153 suspended from two sweep carriages 154 which in turn are each mounted upon a pair of sweep support rods 155. Sweep mechanism 153-155 is employed on the near side of machine 50. A corresponding sweep mechanism (not shown) could be located on the far side of slicing machine equipped for automated loaf loading from both sides. Sweep carriages 154 are driven along rods 155 by belts, not shown in FIG. 3, as indicated by arrows B. Rods 155 are connected to a rotatable sweep actuator 156 for actuation thereby.

Figure 7:
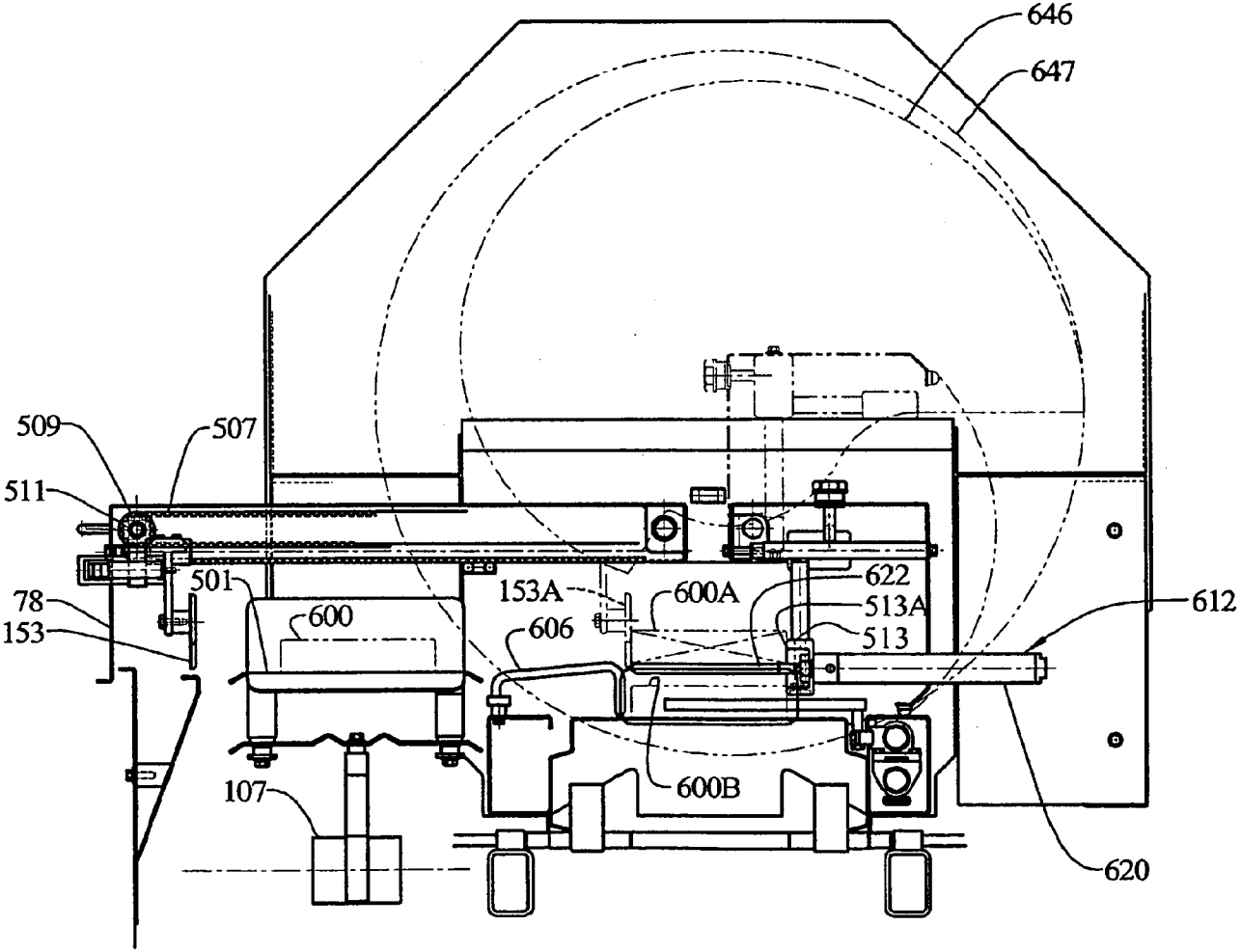
FIG. 7 is a schematic, simplified sectional view of an alternate embodiment automated loaf feed mechanism, taken generally as indicated by line 6-6 in FIG. 5.

Slicing machine 50 is intended to accommodate food loaves of widely varying sizes, including bacon slabs 600 as illustrated in FIG. 7. This makes it necessary to afford a height adjustment for the food loaves as they move from loaf feed mechanism 75 into slicing head 66. In FIG. 3, this height adjustment, described more fully hereinafter, is generally indicated at 161.

Slicing machine 50 further comprises a system of short conveyors for advancing food loaves from loaf feed mechanism 75 into slicing head 66. The short conveyor systems are actually a part of loaf feed mechanism 75. FIG. 3 shows two short lower loaf feed conveyors 163 and 164 on the near and far sides of slicing machine 50, respectively. These short lower conveyors 163 and 164 are located immediately below two short upper feed conveyors 165 and 166, respectively. As used in describing conveyors 163-166, the term "short" refers to the length of the conveyors parallel to the food loaf paths along support 116-118, not to the conveyor lengths transverse to those paths. The upper conveyor 165 of the pair 163 and 165 is displaceable so that the displacement between conveyors 163 and 165 can be varied to accommodate food loaves of varying height. This adjustment is provided by a conveyor lift actuator 167 that urges conveyor 165 downwardly. A similar conveyor actuator is located on the far side of machine 50 to adjust the height of the other upper short conveyor 166; the second actuator cannot be seen in FIG. 3.

On the near side of machine 50 the loaf feed drive mechanism comprising gripper 151 and the short loaf feed conveyors 163 and 165 is driven by a servo motor (not shown) within the base enclosure 53. A like motor (not shown) on the far side of machine 50 affords an independent drive for the gripper and the "short" loaf feed conveyors 164 and 166 on that side of the slicing machine. The motor arrangements are described more completely in U.S. Pat. No. 5,628,237 and European published application EP 0 713 753 A2, herein incorporated by reference.

Figure 4:
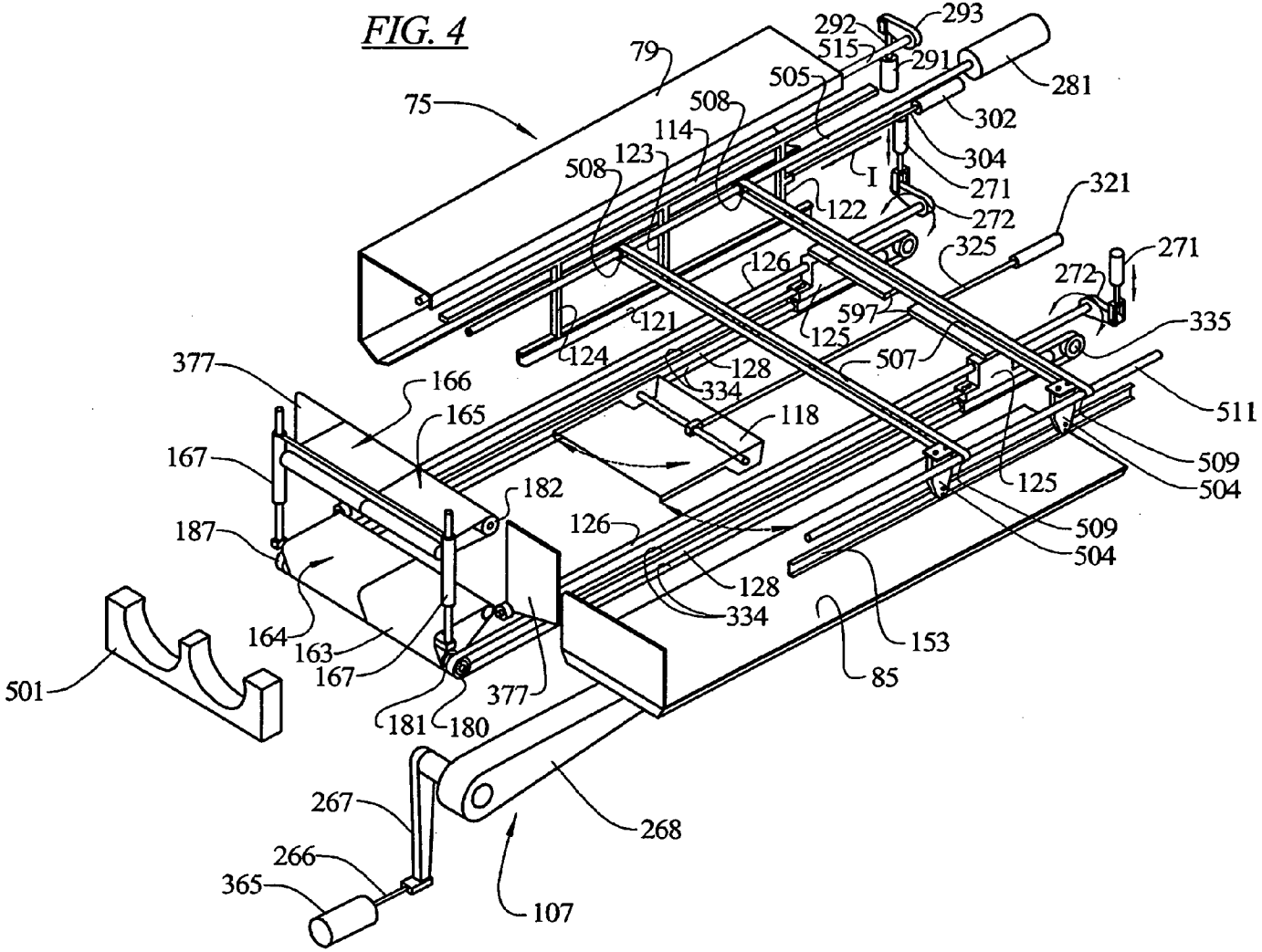
FIG. 4 is a schematic, simplified illustration of operating components of the slicing machine of FIGS. 1-3.

FIG. 4 affords a simplified schematic illustration of most of the loaf loading and loaf feed mechanisms in the slicing machine. Starting at the left-hand side of FIG. 4, it is seen that there is a loaf lift cylinder 365 having an actuating rod 266 connected to a crank 267 that in turn drives a loaf lift lever 268. These members are a part of the loaf lift mechanism 107 that lifts storage tray 85 from its storage position (FIGS. 1-3) into a ready position. The loaf lift mechanism is actuated only during loaf loading; during a loaf feeding/slicing operation, cylinder 365 (FIG. 4) is not normally actuated and keeps tray 85 in its storage position. However, tray 85 may be elevated, ready to load a new loaf or loaves into feed mechanism 75, near the end of slicing.

FIG. 4 shows the "short" conveyors 163-166, with the two upper "short" conveyors 165 and 166 mounted on the housings of cylinders 167. Cylinders 167 have fixed shafts; air applied under pressure to the cylinders tends to drive their housings, and hence conveyors 165 and 166, down toward the lower conveyors 163 and 164. Downward movement of the upper conveyors is blocked by a shear edge member 501 that is specific to the size of loaves being sliced, so that each pair of the conveyors engages opposite sides (top and bottom) of a food loaf being sliced.

The drive pulley 180 is in meshing engagement with a near side timing belt 334 that extends the full length of the loaf feed mechanism 75. Belt 334 is connected to the gripper carriage 125 on the near side of the slicing machine and is used to drive the carriage toward the slicing station. There is a like gripper carriage 125 driven by another long timing belt 334 on the far side of the machine. Timing belt 334 engages an idler sprocket 335 at the right-hand end of the transfer mechanism 75. Two parallel shafts 126 and 128 guide movements of each of the carriages 125. Shafts 128 are stationary but each of the shafts 126 can be rotated by means of a loaf door cylinder 271 and a connecting crank 272. Each carriage 125 has an extension 597 for connection to a loaf end gripper.

Two loaf doors 377, one on each side of the feed mechanism 75, are arranged immediately to the right of conveyors 163-166. The near side loaf door 377 is mounted on shaft 126 so that it can be rotated to close off access of a food loaf into the space between conveyors 163 and 165. Similarly, the far side loaf door 377 is mounted on the other shaft 126 and can be rotated to close off access of a food loaf into the space between conveyors 164 and 166.

FIG. 4 shows the central barrier or divider 121 that is suspended from an auxiliary frame member 114 by three pivotal hangers 122-124. The hanger 122 at the right-hand end of barrier 121, as seen in FIG. 4, is connected by a shaft 304 to air cylinder or other linear actuator 302. Linear actuator 302 can be used to lift barrier 121, pivotally, to a point clear of any food loaves in the loaf feed mechanism, as described hereinafter.

On the near side of the slicing machine, in mechanism 75, there is an elongated sweep member 153; see the lower right-hand portion of FIG. 4. Sweep member 153 is suspended from two hangers/carriages 504, each connected to a drive belt 507. There are structural members, not shown in FIG. 4, that afford further support for the hanger-carriages. Belts 507 are timing belts, each engaging a drive pulley 508 and an idler pulley 509. The idlers 509 are mounted on a shaft 511. The drive pulleys 508 are affixed to a shaft 505 rotated by a loaf sweep motor 281.

FIG. 4 shows a loaf discharge door 118 that is the central part of the loaf support for the slicing machine. Door 118 is shown, in FIG. 4, in its elevated normal position, the position the door occupies when slicing is going forward. Door 118 is connected by a long rod 325 to a linear actuator 321 that opens the door to allow discharge of an unsliced butt end of a loaf, as described below.

Some of the manual loaf loading components of mechanism 75 do not appear in FIG. 4; they are masked by the manual loaf door 79 which is mounted on a shaft 515. Shaft 515 is rotated by a manual door cylinder 291 connected to the shaft by its operating rod 292 and a crank 293.

Figure 5:
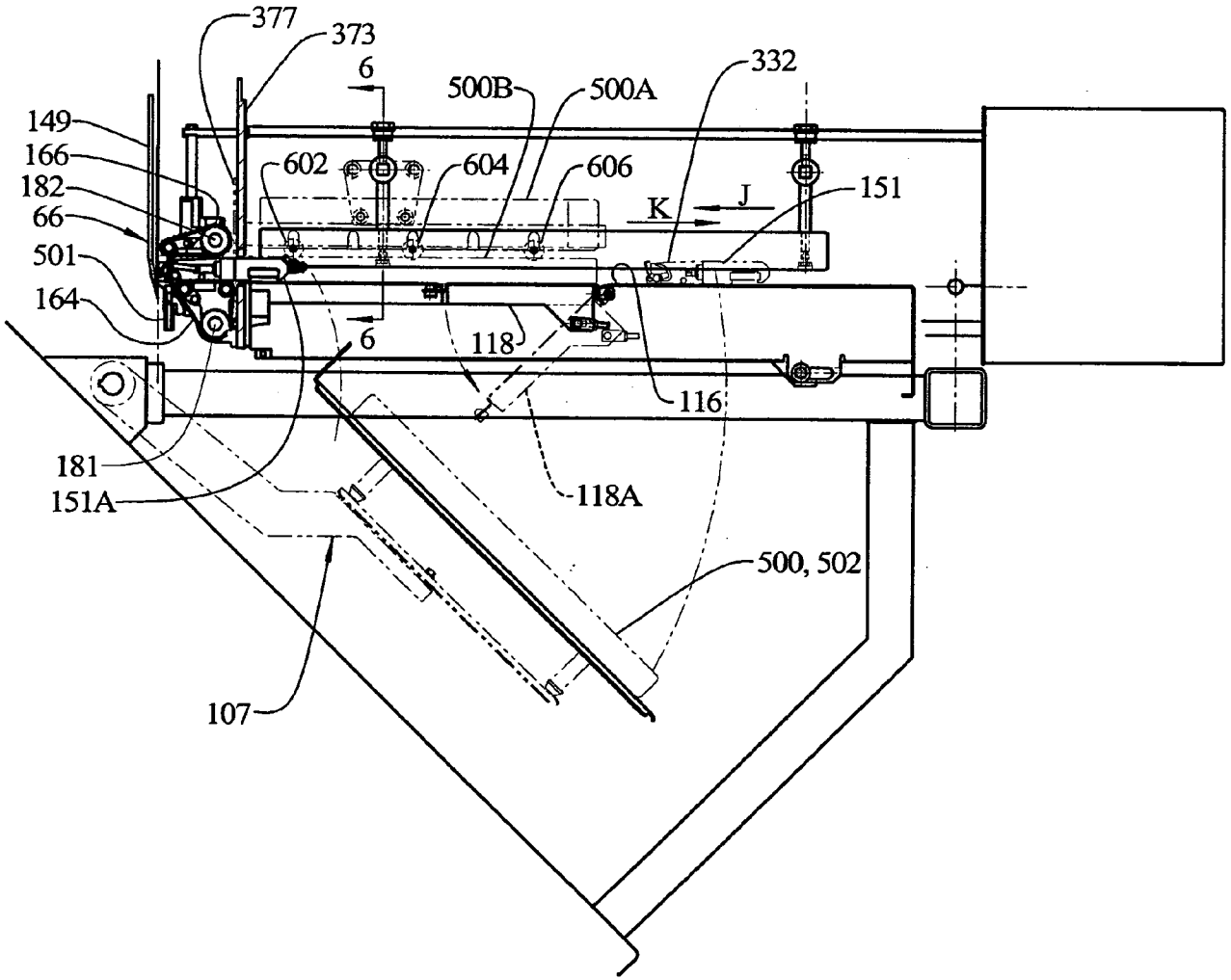
FIG. 5 is a schematic, simplified longitudinal section view of principal components of the loaf feed mechanism for the slicing machine of FIGS. 1-4, taken generally along line 5-5 of FIG. 3.
Figure 6:
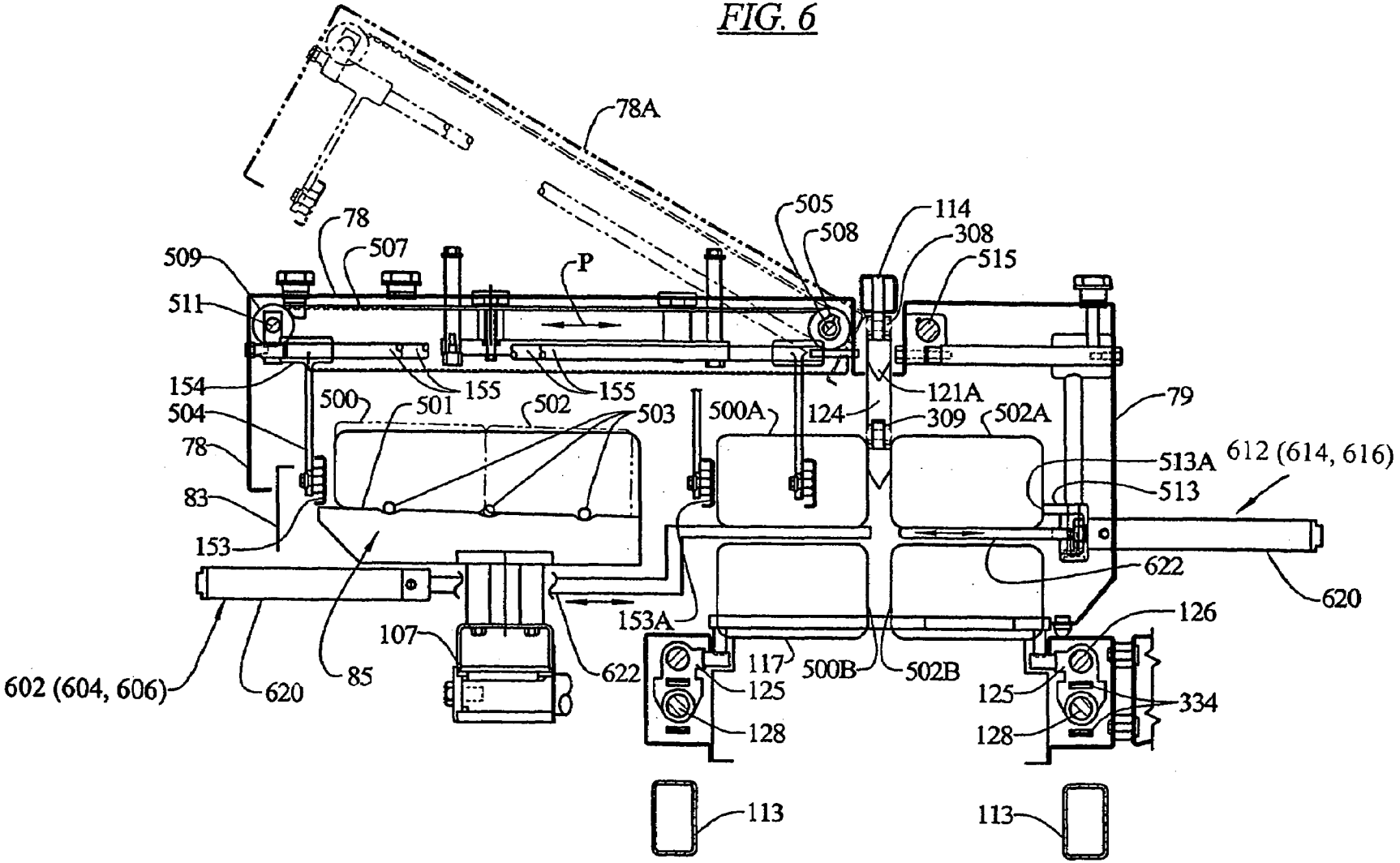
FIG. 6 is a schematic, simplified sectional view of the automated loaf feed mechanism, taken generally as indicated by line 6-6 in FIG. 5.

FIGS. 5 and 6 illustrate the mechanism 75 used to feed two or more loaves along parallel paths, on the supports 116-118 that lead into slicing head 66.

Figure 8:
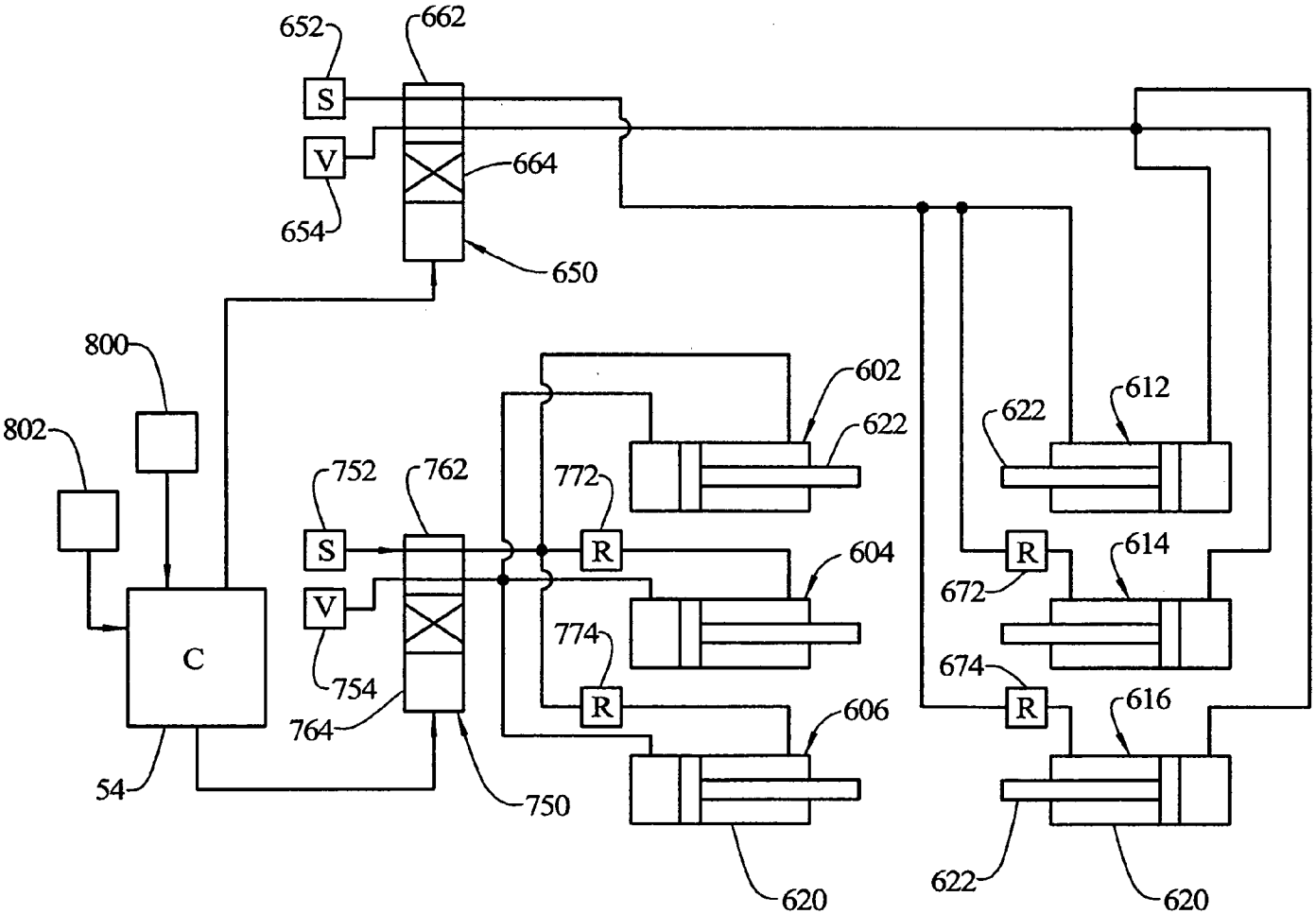
FIG. 8 is a schematic diagram of controls for the loaf feed mechanism.

FIG. 5 illustrates three of six support mechanisms 602, 604, 606 (the remaining three 612, 614, 616 being in complimentary positions over the far side loaf path, see FIGS. 6 and 8) that together constitute the loaf supports for the staging positions indicated at 500A, 502A (FIG. 6).

From the previous description, it will be recognized that slicing machine 50 provides loaf feed means for advancing food loaves along each of the two loaf paths based on supports 116-118. There are independent drives or feed means for each of the loaf paths. One such feed means and its associated drive are shown in FIG. 5. These mechanisms are duplicated for the other, parallel food path.

To understand basic operation of gripper 151, it is sufficient to note that each gripper has a plurality of tines 332 that can be actuated to penetrate and grip one end of a feed loaf supported on members 116-118. Tines 332 can also be released from gripping engagement with the end of the loaf when desired. In FIG. 5, gripper 151 is shown at its home position, ready for use, with its tines 332 retracted.

In addition to gripper 151 and carriage 125 (FIG. 4) and associated drive, each loaf feed means in machine 50 includes two short conveyors, exemplified by conveyors 164 and 166 in FIG. 5. The configuration and operation of the short conveyors is more completely described in U.S. Pat. No. 5,628,237 and European published application EP 0 713 753 A2, herein incorporated by reference.

When a food loaf is first placed on support members 116-118 it may tend to slide down toward slicing station 66; the support members of transfer mechanism 75 are at an angle of 45° as shown in FIGS. 1-3. The upper surfaces of the support members preferably have a textured finish to facilitate sliding of the food loaf. Each loaf path is closed off, near the slicing station 66, by the door or gate 377 (FIGS. 4 and 5) mounted immediately adjacent frame member 373. Thus, a loaf entering mechanism 75 cannot slide down unexpectedly and prematurely into slicing station 66.

Once a food loaf is positioned on its path, gripper 151 is advanced from its home position in the direction of arrow J (FIG. 5) until it engages the end of the loaf farthest from slicing head 66. This is done by driving belt 334 (FIG. 4) that moves the gripper carriage 125 in the direction of arrow J (FIG. 5) until the gripper is blocked by engagement with the end of the food loaf. Where engagement of gripper to loaf occurs is dependent upon the length of the loaf.

When gripper 151 contacts the end of a new loaf, the gripper is energized to actuate its tines 332 to penetrate and clamp onto the loaf end, as described hereinafter. At this juncture, belt 334 moves the gripper carriage back a short distance (e.g. ¼ inch or 0.6 cm); the loaf moves with the gripper. Door 377 of slicing head 66 can now be opened, since the loaf no longer engages the door. The drive for timing belt 334 is again reversed and again advances gripper carriage 125 and gripper 151 in the direction of arrow J, FIG. 5. Actuator 167 (FIG. 4) is continuously energized toward movement in a downward direction, engaging the loaf with the top of a shear edge member 501. The short feed conveyor 166 is thus engaged with the top of the loaf. Thus, the two short feed conveyors 166 and 164 engage the top and bottom, respectively, of the end of the loaf moving into the slicing station, toward blade 149. Both short loaf feed conveyors 164 and 166 are driven at the same speed as timing belt 334; the loaf feed conveyor drive pulleys 181 and 182 are the same size as the drive pulley 180 for belt 334. Other techniques to make sure that feed conveyors 164 and 166 operate at the same speed as belt 334 may be used as desired.

With continued slicing, gripper 151 moves toward slicing station 66, ultimately reaching the end position with the gripper 151 in its end position 151A, FIG. 5. This end position is selected to coincide closely with the end of effective slicing size for the food loaf. The remaining butt end of the food loaf usually should not be sliced; it is likely to yield undersized slices.

When gripper 151 reaches its end position 151A, it is tracked by an encoder (not shown) or by a servomotor, which causes the machine's computer program to stop movement of the loaf toward the slicing station, arrow J in FIG. 5. The drive for timing belt 334 (and for conveyors 164 and 166) is reversed; gripper carriage 125 and gripper 151 start back toward their home positions shown in FIG. 5. See arrow K in FIG. 5. During return movement of gripper 151, support door 118 is opened; door 118 opens to its alternate position 118A, FIG. 5. When gripper 151, in its return movement (arrow K, FIG. 5) reaches a point at which the built end of the food loaf is located over the discharge gap between loaf supports 116 and 117, exposed by opening of door 118, the gripper is reverse energized to open its tines 332 and allow the butt end of the food loaf to drop down clear of the food path. While the gripper 151 continues its return movement to the home position shown in FIG. 5, door 118 is closed, and a new loaf is dropped onto the food loaf path to start a new feed cycle. In machine 50, both grippers 151 may move back up to their home positions at about the same time and two (or more) new food loaves may be loaded into the slicing machine simultaneously at the beginning of each new feed/slicing cycle.

FIG. 6 affords a sectional elevation view of the automated loaf loading mechanism, in a view taken approximately as indicated by line 6-6 in FIG. 5. FIG. 6 includes many of the same components as shown in FIG. 5, and in other Figures of the drawings.

In FIG. 6, loaf loading tray 85 is shown in an operating position to which it is driven by loaf lift mechanism 107 during automated loading of a food loaf into the slicing machine. Loaves 500 and 502 are shown as rectangular loaves having the maximum cross-sectional size acceptable in the slicing machine for slicing of two loaves. In the loaf loading condition shown in FIG. 6, the upper surface 501 of tray 85 is aligned slightly above and inclined slightly downwardly toward the top surface of support rods 622 (described below) of loaf supports 602, 604, 606, 612, 614, 616, on which the new loaves will be placed, over the machine's food loaf paths, in the positions indicated by phantom outline 500A and 502A. Only support mechanisms 602, 612 are shown in FIG. 6, the remaining support mechanism pairs 604, 614 and 606, 616 would be arranged in similar positions but spaced along the longitudinal direction as indicated in FIG. 5.

Each support mechanism 602, 604, 606, 612, 614, 616 comprises a pneumatic actuator 620 acting on an elongated support rod 622. The support rods 622 of the support mechanisms 602, 604, 606 that are adjacent to the tray 85 may have to be vertically offset so that the cylinder 620 does not interfere with movement of the loaves 500, 502 onto the rods 622.

In the portion of the automated loaf loading mechanism shown in solid lines in FIG. 6, door 78 is closed, overlapping the top of guard 83. Door 78 supports the operating mechanism for sweep member 153, which is suspended from two carriages 154 each mounted on two shafts 155 as shown in FIG. 3; only one carriage 154 and one suspension member 504 are shown in FIG. 6. Door 78 is pivotally mounted on a shaft 505 that runs the length of load mechanism 75 (FIGS. 1-3); door 78 is in the position shown in solid lines in FIG. 6 but is pivoted (clockwise in FIG. 6) to a mechanism access position 78A during clean-up of machine 50.

Sweep carriage 154, which slides along two shafts 155, is connected to an elongated timing belt 507. At one end, belt 507 engages a drive pulley 508; drive pulley 508 is affixed to shaft 505. The other, outer end of belt 507 engages an idler pulley 509 on a shaft 511 that is parallel to shaft 505.

At the beginning of an automated loaf loading operation the loaf loading tray 85 is moved up to the position shown in FIG. 6, aligning new loaves 500 and 502 on tray surface 501 with the supports 602, 604, 606, 612, 614, 616 on which the loaves rest while in the staging positions. The drive for pulley 508 and shaft 505 operates to drive the upper run of belt 507 to the left, in FIG. 6, in the direction indicated by arrows P. This moves the lower run of belt 507 toward the center of the slicing machine, to the right as seen in FIG. 6. The belt movement drives carriage 154 and suspension member 504 to the right along shafts 155 and moves sweep member 153 toward and past its position at 153A, pushing the new loaves 500 and 502 into the slicing machine until the movement of loaf 502 is interrupted at position 502A with that loaf engaging a guide 501 at side 513A at the opposite side of the machine. While this loaf loading operation is going forward, the center barrier 121 is elevated, clear of the staging positions, to its elevated position at 121A. Thus, the two new loaves 500 and 502 are in contact with each other, as shown on tray 85 in FIG. 6, during this part of the loading cycle.

At this point in the automated loaf loading cycle, sweep member 153 is backed off the left, as seen in FIG. 6, and the center barrier 121 is driven down from its elevated position 121A to position 121 between the two new loaves. The barrier/divider 121, which is preferably generally V-shaped in cross section, constitutes an elongated barrier located at the center of the loaf feed mechanism 75. The downward movement of barrier 121 drives one loaf to position 500A on the support mechanisms 602, 604, 606 over the left-hand food loaf path; the loaf in position 502A is already aligned on the support mechanisms 612, 614, 616 over the right-hand food loaf path. The barrier 121 is again elevated to position 121A where it is clear of the air lines that are connected to the grippers. This completes the automated loading of loaves into the staging positions.

Displacement of barrier 121 between its first and second operating positions is effected by the barrier displacement means of FIG. 4 and as described in U.S. Pat. No. 5,628,237 and European published application EP 0 713 753 A2, herein incorporated by reference.

The loaves 500, 502 are then lowered from the staging positions 500A, 502A to the loading positions 500B, 502B by the retraction of the support rods 622 into the cylinders 620 of all support mechanisms 602, 604, 606, 612, 614, 616. The retraction of the support rods 622 undermines the loaves 500,502 which drop into the loading positions 500B, 502B. Preferably, the support mechanisms are actuated in a sequence from front support mechanisms (closest to the cutting blade) to back support mechanisms, as described below.

FIG. 7 illustrates another, more simplified version of the apparatus described above. According to this configuration a single loaf, such as a bacon slab 600, is swept by the sweep member 153 from the upper surface 501 of tray 85, over a plurality of parallel bent guide rods 606 and onto the support rods 622 of the support mechanisms 612, 614, 616. Only one guide rod 606 is shown. It is to be understood that there is a guide rod 606 arranged adjacent to each support rod 622 so that the slab 600 is adequately supported as it is moved by the sweep member 153 from the tray 85 onto the support rods 622. According to this configuration the sweep member 153 moves the slab 600 across the guide rods 606 and onto the support rods 622 until the slab 600 contacts the guide 513 at the position 513A. The slab is then in the staging position 600A. The sweep member 153 can then be retracted to its home position. Since there is only one slab 600, the barrier 121 and its associated mechanisms and the support mechanisms 602, 604, 606 as described in FIGS. 6 and 8, can be eliminated. As described below, the slab 600 in the staging position 600A can then be lowered to the loaded position at 600B by operation of the support mechanisms 612, 614, 616 to retract the rods 622 into the respective cylinders 620.

FIG. 7 also shows in phantom an alternative involute-shaped blade 646 of the cutting head 66 and its cutting path 647.

FIG. 8 illustrates in schematic fashion the control system for the support mechanisms 602, 604, 606 (configuration of FIG. 6), and the support mechanisms 612, 614, 616 (configurations of FIGS. 6 and 7). The system computer or controller 54 is signal-connected to a first solenoid valve 650 which is pneumatically connected to a pressurized air supply 652 and to a vent 654. The solenoid valve 650 has two positions: a first position 662 for retracting the support rods 622, and an alternate, second position 664 for extending the support rods 622. The first position of the solenoid valve 650 is shown in FIG. 8.

While the gripper 151 is being retracted to its home position, the pressurized air supply is delivered into the cylinders 620 of the support mechanisms 612, 614, 616 to retract the rods 622 into the cylinders 620 to undermine the loaf or slab, to drop the loaf or slab onto the supports 116-118. It is preferred that the support rods 622 are retracted sequentially with the first support mechanism 612 closest to the slicing head 66 retracted first and the last support mechanism 616, farthest from the slicing head 66, retracted last. To accomplish this, a restriction 672 is placed into the pneumatic line connected to the cylinder 620 of the support mechanism 614, and an even greater restriction 674 is placed in the pneumatic line connected to the cylinder 620 of the support mechanism 616. No restriction is needed in the pneumatic line to the first support mechanism 612.

Thus, when pressurized air is supplied to the support mechanisms 612, 614, 616, because of airflow, both unrestricted and restricted, the rods 622 will be retracted sequentially with the rod 622 of the support mechanism 612 being retracted first, the rod 622 of the support mechanism 614 being retracted second, and the rod 622 of the support mechanism 616 being retracted last. Thus, the slab falls progressively down onto the supports 116-118. The controller 54 is programmed such that the actuation of the rods 622 of the support mechanisms 612, 614, 616 is sequentially timed and synchronized with the retraction of the gripper 151 along that loaf path, such that the slab falls onto the supports 116-118 trailing the respective gripper 151 by a minimum amount as it is retracted to its home position. In this regard, the position of the respective gripper 151 along the loaf path can be sensed and communicated to the controller 54 by a sensor 800 that can be the servomotor that drives the timing belt 334 for that gripper, or by an encoder operatively associated with a rotating component that drives the belt, or by sensors on the loaf path.

The above description is sufficient for the configuration shown in FIG. 7. For the configuration shown in FIG. 6 there is an additional solenoid valve 750 which is pneumatically connected to a pressurized air supply 752 and to a vent 754. The solenoid valve 750 has two positions: a first position 762 for retracting the support rods 622, and an alternate, second position 764 for extending the support rods 622. The first position of the solenoid valve 750 is shown in FIG. 8.

While the gripper 151 is being retracted to its home position, the pressurized air supply is delivered into the cylinders 620 of the support mechanisms 602, 604, 606 to retract the rods 622 into the cylinders 620 to undermine the loaf or slab, to drop the loaf or slab onto the supports 116-118. It is preferred that the supports rods 622 are retracted sequentially with the first support mechanism 602 closest to the slicing head 66 retracted first and the last support mechanism 606, farthest from the slicing head 66, retracted last. To accomplish this, a restriction 772 is placed into the pneumatic line connected to the cylinder 620 of the support mechanism 604, and an even greater restriction 774 is placed in the pneumatic line connected to the cylinder 620 of the support mechanism 606. No restriction is needed in the pneumatic line to the first support mechanism 602.

Thus, when of pressurized air is supplied to the support mechanisms 602, 604, 606, because of airflow, both unrestricted and restricted, the rods 622 will be retracted sequentially with the rod 622 of the support mechanism 602 being retracted first, the rod 622 of the support mechanism 604 being retracted second, and the rod 622 of the support mechanism 606 being retracted last. Thus, the slab falls progressively down onto the supports 116-118. The controller 54 is programmed such that the actuation of the rods 622 of the support mechanisms 602, 604, 606 is sequentially timed and synchronized with the retraction of the gripper 151 along that loaf path, such that the slab falls onto the supports 116-118 trailing the respective gripper 151 by a minimum amount as it is retracted to its home position. In this regard the position of the gripper 151 along the loaf path can be sensed and communicated to the controller 54 by a sensor 802 that can be the servomotor that drives the timing belt 334, or by an encoder operatively associated with a rotating component that drives the belt, or by sensors on the loaf path.

In operation, by progressively dropping the slab onto the supports 116-118 as the gripper 151 is being retracted, it is not necessary to delay the reloading of a loaf into the food loaf path until the gripper has reached its home position. A significant amount of production time can be saved by this method. This method can reduce the reload time by as much as 50 percent. In a high-speed production, significant savings can be achieved.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. In a slicing machine that includes a loaf-loading support wherein during a loading operation a loaf is placed in the loaf-loading support, a gripper that moves from a home position clear of a loaf on the loaf-loading support to an engagement position wherein the gripper engages a trailing end of the loaf, wherein during a slicing operation, the gripper moves with the loaf along a longitudinal path into a slicing plane of a moving slicing blade until the loaf is effectively entirely sliced by the blade, wherein the gripper is then retracted in a reverse direction to the home position, the improvement comprising:

a loaf-staging support extended along, parallel with, and in vertical alignment with, the loaf-loading support;

a lowering mechanism configured to deliver a loaf in a vertical direction from the loaf-staging support to the loaf-loading support;

a loaf-ready support laterally adjacent to the loaf-staging support; and a sweep mechanism configured to laterally move a loaf from the loaf-ready support into the loaf-staging support; and wherein said lowering mechanism is arranged to deliver the loaf in said vertical direction that is at an angle to the longitudinal path.

2. The improvement according to claim 1, wherein said loaf-staging support comprises a series of loaf supports that are sequentially removed by said lowering mechanism along the longitudinal path as the gripper is retracted, to sequentially undermine the loaf to drop the loaf progressively onto the loaf-loading support as the gripper is retracted.

3. A loaf slicing machine, comprising:

a blade that moves in a slicing plane to slice a loaf;

a first loaf support for guiding a loaf for longitudinal movement in a longitudinal direction along a loaf path to the slicing plane, said first loaf support extending to a position adjacent to said slicing plane and arranged to guide a leading end of the loaf into the slicing plane to be sliced by the blade;

a second loaf support that is above, extends along, and parallel with, said first loaf support such that a loaf on said second loaf support has a lead end at a first distance to said slicing plane and a loaf on said first loaf support before slicing commences has a lead end at a second distance to said slicing plane, wherein said first and second distances are substantially equal; and a loaf-delivery means for progressively delivering the loaf from the second loaf support onto the first loaf support, wherein an end of the loaf that is closest to the slicing plane is delivered first from the second loaf support onto the first loaf support, and an opposite end of the loaf that is farthest from the slicing plane is delivered last from the second loaf support onto the first loaf support;

wherein said loaf-delivery means is arranged to deliver the loaf in a direction that is at an angle to the longitudinal direction.

4. The loaf-slicing machine according to claim 3, wherein said second loaf support comprises a plurality of support elements that are sequentially removed from under the loaf by said loaf-delivery means.

5. The loaf-slicing machine according to claim 4, wherein said support elements each comprise a support rod, and said loaf-delivery means comprises a plurality of pneumatic cylinders, each cylinder operatively associated with one support rod, and each said cylinder acts on said one rod using pneumatic force to either extend or retract said rod, each support rod supporting a portion of a loaf when in an extended position and releasing said portion of said loaf when said rod is retracted by said cylinder.

6. The loaf-slicing machine according to claim 4, comprising a third loaf support and a displacement mechanism, said displacement mechanism configured to move a loaf from said third loaf support onto said second loaf support, said third loaf support laterally adjacent to said second loaf support.

7. A loaf slicing machine, comprising:

a blade that moves in a slicing plane to slice a loaf;

a first loaf support having a support surface arranged to guide a loaf for longitudinal movement in a longitudinal direction along a loaf path to the slicing plane, said support surface extending to a position adjacent to said slicing plane and arranged to guide a leading end of the loaf into the slicing plane to be sliced by the blade;

a loaf engagement element that engages a trailing end of the loaf and moves from a home position for the slicing plane along the loaf path with the loaf being sliced and then retracts along the loaf path to the home position after the loaf is sliced;

a second loaf support that is above, extends along, and parallel with, said first loaf support, such that a loaf on said second loaf support has a lead end at a first distance to said slicing plane and a loaf on said first loaf support before slicing commences has a lead end at a second distance to said slicing plane, wherein said first and second distances are substantially equal, said second loaf support arranged for supporting a next loaf to be subsequently loaded onto said first loaf support; and a loaf-delivery mechanism operatively connected to said second loaf support and operable to progressively displace the next loaf from the second loaf support onto the first loaf support, wherein a leading end of the next loaf that is closest to the slicing plane is displaced first from the second loaf support onto the first loaf support, and a trailing end of the next loaf that is farthest from the slicing plane is displaced last from the second loaf support onto the first loaf support;

wherein the leading end of the next loaf reaches the first loaf support before the engagement element has completely retracted to the home position; and wherein said loaf-delivery mechanism is arranged to deliver the loaf in a direction that is at an angle to said longitudinal direction.

8. The loaf-slicing machine according to claim 7, wherein said second loaf support comprises a plurality of support elements that are sequentially removed from under the loaf by said loaf-delivery mechanism to progressively displace the next loaf from the second loaf support down onto the first loaf support.

9. The loaf-slicing machine according to claim 8, wherein said support elements each comprise a support rod, and said loaf-delivery mechanism comprises a plurality of pneumatic cylinders, each cylinder operatively associated with one support rod, and each said cylinder acts on said one rod using pneumatic force to either extend or retract said rod, each support rod supporting a portion of a loaf when in an extended position and releasing said portion of said loaf when said rod is retracted by said cylinder.

10. The loaf-slicing machine according to claim 8, comprising a third loaf support and a displacement mechanism, said displacement mechanism configured to move a loaf from said third loaf support onto said second loaf support, said third loaf support laterally adjacent to said second loaf support.

11. A loaf slicing machine, comprising:

a blade that moves in a slicing plane to slice a loaf;

a first loaf support means for guiding a loaf for longitudinal movement in a longitudinal direction along a loaf path to the slicing plane to guide a leading end of the loaf into the slicing plane to be sliced by the blade;

a second loaf support means for supporting a next loaf to be subsequently loaded onto said first loaf support means, said second loaf support means extending along, disposed above and parallel to said first loaf support means such that said next loaf on said second loaf support means is oriented to be parallel to a loaf being sliced on said first loaf support means, and said next loaf has a lead end at a first distance to said slicing plane and a loaf on said first loaf support means has a lead end before slicing commences at a second distance to said slicing plane, wherein said first and second distances are substantially equal; and a loaf-delivery means for progressively displacing the next loaf from the second loaf support means onto the first loaf support means, wherein an end of the loaf that is closest to the slicing plane is displaced first from the second loaf support means onto the first loaf support means, and an opposite end of the loaf that is farthest from the slicing plane is displaced last from the second loaf support means onto the first loaf support means;

wherein said loaf-delivery means is arranged to deliver the loaf in a direction that is at an angle to said longitudinal direction.

12. The loaf-slicing machine according to claim 11, wherein said second loaf support means comprises a plurality of support elements that are sequentially removed from under the loaf by said loaf-delivery means to progressively displace the next loaf from the second loaf support means onto the first loaf support means.

13. The loaf-slicing machine according to claim 12, wherein said support elements each comprise a support rod, and said loaf-delivery means comprises a plurality of pneumatic cylinders, each cylinder operatively associated with one support rod, and each said cylinder acts on said one rod using pneumatic force to either extend or retract said rod, each support rod supporting a portion of a loaf when in an extended position and releasing said portion of said loaf when said rod is retracted by said cylinder.

14. The loaf-slicing machine according to claim 11, comprising a third loaf support means and a displacement means, said displacement means configured to move a loaf from said third loaf support means onto said second loaf support means, said third loaf support means laterally adjacent to said second loaf support means.

* * * * *